US005423691A

United States Patent [19]

Pickles

[11] Patent Number: 5,423,691

[45] Date of Patent: Jun. 13, 1995

[54] EDGE CARD INTERCONNECTION SYSTEM

[75] Inventor: Charles S. Pickles, N. Attleboro, Mass.

[73] Assignee: Augat Inc., Mansfield, Mass.

[21] Appl. No.: 103,458

[22] Filed: Aug. 6, 1993

Related U.S. Application Data

[63] Continuation-in-part of Ser. No. 847,973, Mar. 6, 1992, abandoned.

[51] Int. Cl.[6] ..... H01R 13/62

[52] U.S. Cl. ..... 439/327; 439/630

[58] Field of Search ..... 439/326, 328, 327, 377, 439/65, 68, 259, 260, 261, 267, 268, 350, 352, 357, 358

[56] References Cited

U.S. PATENT DOCUMENTS

| | | | |
|---|---|---|---|
| 3,084,302 | 4/1963 | Braeutigam | 439/327 |
| 3,101,230 | 8/1963 | Bausch et al. | 439/357 |
| 3,246,279 | 4/1966 | Storcel . | |
| 3,550,062 | 12/1970 | Drenten et al. | 439/327 |
| 3,638,167 | 1/1972 | Occhipinti et al. | 439/267 |
| 3,706,954 | 12/1972 | Krafthefer | 439/65 |
| 3,710,303 | 1/1973 | Gallager, Jr. . | |
| 3,718,895 | 2/1973 | Reynolds et al. . | |
| 3,784,955 | 1/1974 | Reynolds et al. . | |
| 3,803,533 | 4/1974 | Donovan . | |
| 3,920,303 | 11/1975 | Pittman et al. . | |

(List continued on next page.)

FOREIGN PATENT DOCUMENTS

| | | | |
|---|---|---|---|
| 0093510 | 4/1983 | European Pat. Off. | H01R 13/627 |
| 0277873 | 1/1988 | European Pat. Off. | H01R 23/70 |

OTHER PUBLICATIONS

Meyer, G. E., "Spring Retainer for Retention of Cable Connector," *IBM Technical Disclosure Bulletin*, vol. 20, No. 5, Oct., 1977, pp. 1887–1888.

Specification sheet for Augat 3900 Series Latch, Augat Inc., Attleboro, Falls, Ma. 02763 (1991).

Specification sheet for Molex SIMM Socket 78810 Series, Molex Incorporated, Lisle, Ill. 60532 (Revised 2/85).

Molex SIMM Socket Technology Handbook, Molex Incorporated, Lisle, Ill. 60532.

*Primary Examiner*—Larry I. Schwartz
*Assistant Examiner*—Hien D. Vu
*Attorney, Agent, or Firm*—Weingarten, Schurgin, Gagnebin & Hayes

[57] ABSTRACT

An edge card interconnection system provides enhanced electrical interconnection between a module and a circuit board. Electrical contact length is minimized and deflection of the contacts is controlled as the system is configured to eliminate the need for the contacts to absorb module thickness tolerances. A latching mechanism is easily manipulated and provides significant protection to modules being installed/extracted. A hold-down mechanism facilitates enhanced engagement of the connector with the printed circuit board. An insulative connector portion includes a back-up spring that pushes an inserted module against a set of contacts. Deflection of the contacts is controlled by a wall of the connector portion that prohibits the module from deflecting the contacts beyond a preset amount. The back-up spring absorbs any tolerance(s) in board thickness. A module latch and protection mechanism includes latch arms for engagement with a connector body, the latch arms have tabs disposed thereon upon which manual forces are exerted to release the latch arms from the associated connector body latch mating portion. A connector hold-down mechanism is provided which snaps onto ends of the insulative connector housing and is soldered into a plated through-hole, to fasten the edge card interconnection system to a printed circuit board. The connector hold-down mechanism may have compliant protuberances which engage the plated through-holes in the printed circuit board to guarantee contact to the barrel of the plated through-hole and ensure proper solder attachment thereto.

5 Claims, 15 Drawing Sheets

U.S. PATENT DOCUMENTS

| | | | |
|---|---|---|---|
| 3,932,016 | 1/1976 | Ammenheuser | 439/377 |
| 4,080,037 | 3/1978 | Kunkle et al. . | |
| 4,128,289 | 12/1978 | Occhipinti . | |
| 4,129,351 | 12/1978 | Sugimoto et al. . | |
| 4,136,917 | 1/1979 | Then et al. . | |
| 4,145,103 | 5/1979 | Knowles . | |
| 4,186,982 | 2/1980 | Cobaugh et al. . | |
| 4,188,083 | 2/1980 | Knowles . | |
| 4,362,353 | 12/1982 | Cobaugh et al. . | |
| 4,384,757 | 5/1983 | Andrews, Jr. et al. . | |
| 4,480,885 | 11/1984 | Coppelman | 439/65 |
| 4,575,172 | 3/1986 | Walse et al. . | |
| 4,576,427 | 3/1986 | Verbruggen | 439/267 |
| 4,589,794 | 5/1986 | Sugiura et al. | 403/187 |
| 4,640,562 | 2/1987 | Shoemaker | 439/327 |
| 4,656,605 | 4/1987 | Clayton | 365/52 |
| 4,693,533 | 9/1987 | Szczesny et al. | 439/350 |
| 4,709,302 | 11/1987 | Jordan et al. | 361/388 |
| 4,713,013 | 12/1987 | Regnier et al. | 439/62 |
| 4,722,700 | 2/1988 | Kuhn et al. | 439/629 |
| 4,725,250 | 2/1988 | Kuhn et al. | 439/629 |
| 4,726,783 | 2/1988 | Nakazawa et al. | 439/350 |
| 4,727,513 | 2/1988 | Clayton | 365/52 |
| 4,735,583 | 4/1988 | Rudy, Jr. et al. | 439/350 |
| 4,737,120 | 4/1988 | Grabbe et al. | 439/326 |
| 4,756,694 | 7/1988 | Billman et al. | 439/61 |
| 4,763,408 | 8/1988 | Heisey et al. | 29/874 |
| 4,781,612 | 11/1988 | Thrush | 439/328 |
| 4,850,891 | 7/1989 | Walkup et al. | 439/326 |
| 4,850,892 | 7/1989 | Clayton et al. | 439/326 |
| 4,857,018 | 8/1989 | Pickles | 439/751 |
| 4,869,672 | 9/1989 | Andrews, Jr. | 439/60 |
| 4,898,540 | 2/1990 | Saito | 439/153 |
| 4,923,409 | 5/1990 | Ishii | 439/358 |
| 4,929,194 | 5/1990 | Korsunsky et al. | 439/571 |
| 4,961,711 | 10/1990 | Fujiura et al. | 439/357 |
| 4,986,765 | 1/1991 | Korsunsky et al. | 439/326 |
| 4,995,825 | 2/1991 | Korsunsky et al. | 439/328 |
| 5,004,429 | 4/1991 | Yagi et al. | 439/326 |
| 5,021,002 | 6/1991 | Noschese | 439/352 |
| 5,094,624 | 3/1992 | Bakke et al. | 439/326 |
| 5,154,627 | 10/1992 | Lee | 439/326 |
| 5,201,661 | 4/1993 | Ii | 439/260 |

EDGE CARD INTERCONNECTION SYSTEM

RELATED APPLICATION

The present application is a continuation-in-part of commonly owned, U.S. application Ser. No. 07/847,973, entitled EDGE CARD INTERCONNECTION SYSTEM, filed Mar. 6, 1992, now abandoned.

FIELD OF THE INVENTION

The present invention relates to an edge card interconnection system and in particular to an edge card interconnection system for interconnecting a module with an electronic printed circuit board.

BACKGROUND OF THE INVENTION

Edge card interconnection systems are known for interconnecting modules with electronic printed circuit boards. Known modules, such as single in-line memory modules (SIMM) and electronic sub-assembly daughter board modules require interconnection with a main electronic module or mother board, which typically involves implementing an edge connection scheme wherein contact pads on the edge of the module are engagable with contacts in a connector or socket on the main module or motherboard.

Implementations such as the EISABUS Connector, illustrated in FIG. 1, and a typical SIMM socket, illustrated in FIG. 2, effect a connection to a module or card edge which results in electrical contacts 10, 10' accommodating or absorbing tolerances associated with the module thickness (i.e. board thickness tolerance). As illustrated in FIGS. 1 and 2, prior art connectors receive modules having contact pads which are accommodated by a contact gap 12 within the mating connector. The contact gap 12 is typically of a lesser dimension than the thickness of the module so that the contacts 10, 10' deflect upon receipt of the module within the contact gap 12. Thus, the contacts absorb the entire board thickness tolerance of the module and must be configured to accommodate varying thicknesses due to the typical non-uniformity of module thickness. Generally, contacts are sufficiently dimensioned, e.g. are made longer, so as to permit sufficient deflection to accommodate thickness tolerances. Such contacts, which may be longer than is absolutely necessary, introduce undesirable propagation delay to an electrical signal as it is conducted through the connector. Further, frequent deflection of such unnecessarily long contacts results in degradation of the resiliency of the contact which causes the contact gap to undesirably expand and diminish contact integrity.

Known edge card interconnection systems, such as the one illustrated in FIGS. 3 and 3A, also typically have a latching mechanism which serves to maintain a module, such as a SIMM, in alignment within the connector. Known latches 14 typically reside within a cavity or behind walls in the connector body and are constrained in configuration by the connector members or walls which contain the latch. Such latches, like the contacts known in the prior art, are subject to resiliency degradation over time as a result of frequent deflection. Known latches, especially when disposed within a recess, are difficult to manually access and manipulate for extracting a module from the connector. Further, known latches typically require that the module being engaged have a hole 16 or latch engagement feature for receiving a module engagement portion 18 of the latch. As latch resiliency degrades and/or the latch 14 becomes loosened within its recess, alignment of the latch engagement hole and the latch becomes evermore difficult resulting in module alignment problems and electrical contact degradation. Further, latch engaging holes proximate to a module edge, may create vulnerable areas of the module. Such vulnerable module areas, when left unprotected and exposed to the forces associated with manual manipulation of the latch for extraction, may be susceptible to breakage.

Additionally, known edge card interconnection systems typically incorporate hold-down mechanisms for attaching the connector, usually by epoxy or soldering, to a circuit board. A known hold-down mechanism, as illustrated in FIG. 4 is an integral plastic member 20 which is epoxied to the circuit board 22 for holding the connector housing in place. However, epoxied integral plastic members are difficult to remove from the printed circuit board without causing damage to the board and/or the protuberance.

Alternatively, a solderable protrusion 24, such as illustrated in FIG. 4A, is integrated with the housing and is soldered to a through-hole in the printed circuit board to secure the connector thereto. Solderable protuberances are typically non-compliant and rely heavily on a butt solder joint to maintain hold-down engagement with the printed circuit board. As the solderable member must be dimensioned to fit easily into through-holes of various tolerances, significant gaps between the protuberance and the through-hole may be present, causing difficulty in soldering and diminishing the integrity of the hold-down.

SUMMARY OF THE INVENTION

The present invention provides an edge card interconnection system having enhanced electrical interconnection between a module and a circuit board. Electrical contact length is minimized and deflection of the contacts is controlled as the system is configured to eliminate the need for the contacts to absorb module thickness tolerances. A latching mechanism is easily manipulated and facilitates a means of extraction providing significant protection to modules being installed or extracted. The latching mechanism is configured to provide an audible click during latching. A hold-down mechanism facilitates enhanced engagement of the connector with the printed circuit board.

According to the invention the edge card interconnection system comprises an insulative connector portion including a backup or backing spring that pushes an inserted module against a set of contacts. Deflection of the contacts is controlled by a wall of the connector portion that prohibits the module from deflecting the contacts beyond a preset amount. The back-up spring absorbs tolerance(s) in board thickness and can be implemented in a plurality of configurations.

In further accord with the invention, the interconnection system comprises a module latch and protection mechanism including latch arms for engagement with an interface or insulative connector portion. The latch arms have tabs or other members disposed thereon which are manually actuatable to release the latch arms from an associated connector body latch mating portion.

In still further accord with the invention, a connector hold-down mechanism is provided which snaps onto ends of the insulative connector portion or housing and is soldered into a plated through-hole, to fasten the edge card interconnection system to a printed circuit board. The connector hold-down mechanism has guides or grooves which mate with rails on the insulative connector housing to guide the hold-down mechanism into place on the insulator. Upon full engagement of the hold-down mechanism onto the insulative connector housing, a resilient tab having an engagement surface engages a tab receptacle to maintain the hold-down mechanism in place on the insulative connector housing. The connector hold-down mechanism has compliant protuberances which engage plated through-holes in the printed circuit board to guarantee contact to the barrel of the plated through-hole and ensure proper solder attachment thereto.

Features of the invention include the use of shorter electrical contacts in the interconnection system to minimize propagation delays experienced by electrical signals. The module latch and protection mechanism facilitates protected insertion and extraction of modules into and out of the connector, and issues a tactile and/or audible response when the device is mated in the connector housing. The latch and protection mechanism and associated module can be keyed to preclude insertion of an improperly oriented module. The compliant protuberance on the connector hold-down mechanism provides greater reliability in connecting the interconnection system to a printed circuit board, due to the large range of tolerances in printed circuit board through-holes that it will engage. The snap action engagement of the connector hold-down mechanism to the connector body provides enhanced rigidity in fastening the edge card interconnection system to a printed circuit board.

DESCRIPTION OF THE DRAWINGS

These, and other features and advantages of the present invention will be better understood by reading the following detailed description, taken together with the drawings wherein:

FIG. 10 is a second alternative embodiment of a module latching and protection mechanism;

DETAILED DESCRIPTION OF THE INVENTION

Figure 5:
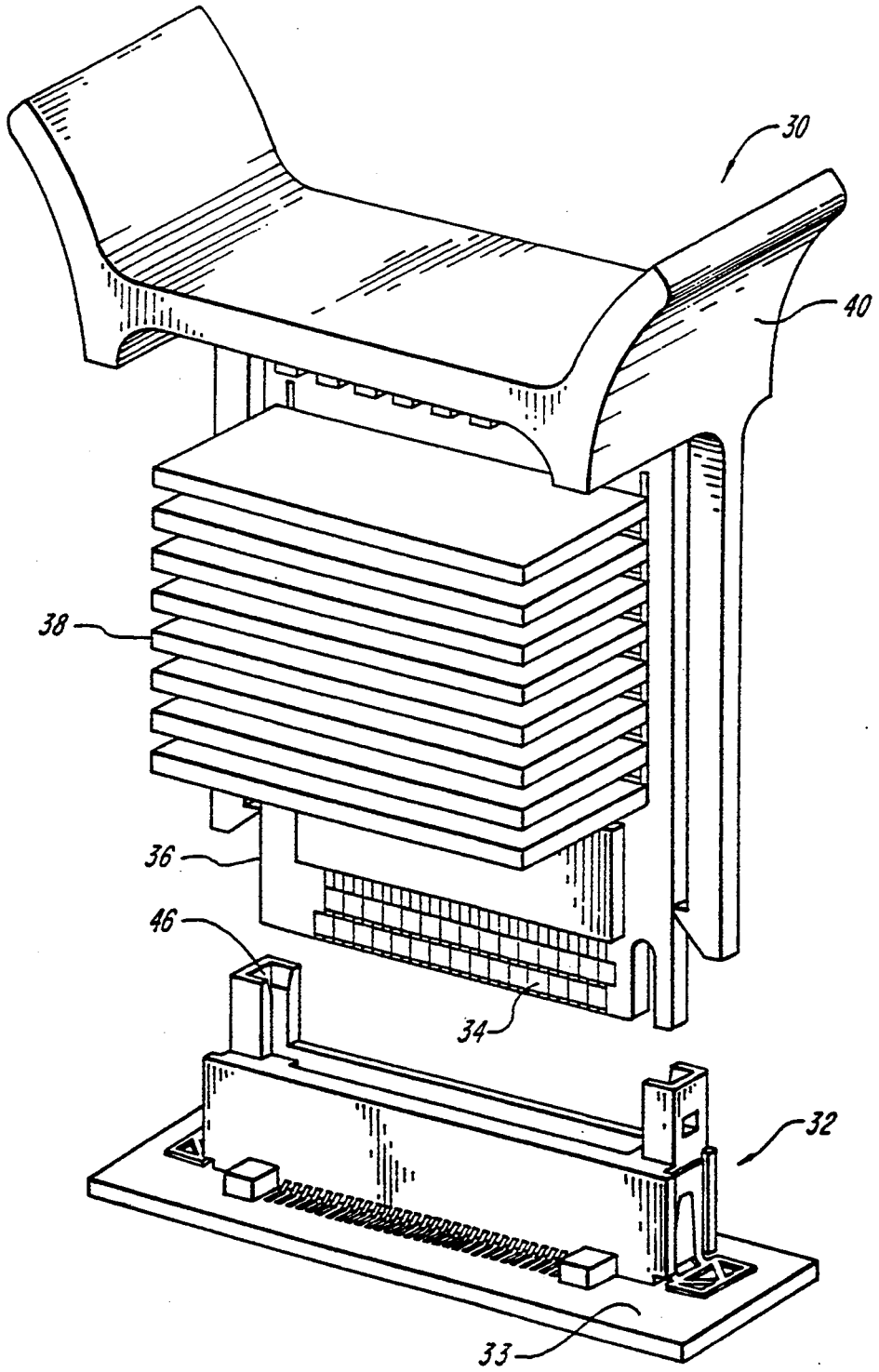
FIG. 5 is a perspective view of an embodiment of an edge card interconnection system according to the invention.

Referring now to FIG. 5, an edge card interconnection system 30 comprises a connector portion 32 which is electrically engagable with a main module or motherboard 33 in various ways known in the art, such as by surface mount technology mounting, through-hole engagement, or the like. The connector portion 32 includes internal contacts (not shown in FIG. 5), discussed hereinafter for receiving and facilitating edge card interconnection with contact pads 34 disposed along an edge of a module 36 to be electrically interconnected with a main circuit board 33. The module 36 includes a plurality of electronic circuits such as memory modules 38. The module 36 is attached to a module latching and protection mechanism 40 via mechanical fastening means such as screws, rivets, nuts and bolts or the like (not shown). The module latching and protection mechanism 40 facilitates protected manual grasping of the module 36 for insertion and extraction from the connector portion 32. Various implementations of the module latching and protection mechanism 40, as discussed hereinafter, can be configured for engaging the module 36 and permitting manual manipulation thereof.

Figure 6:
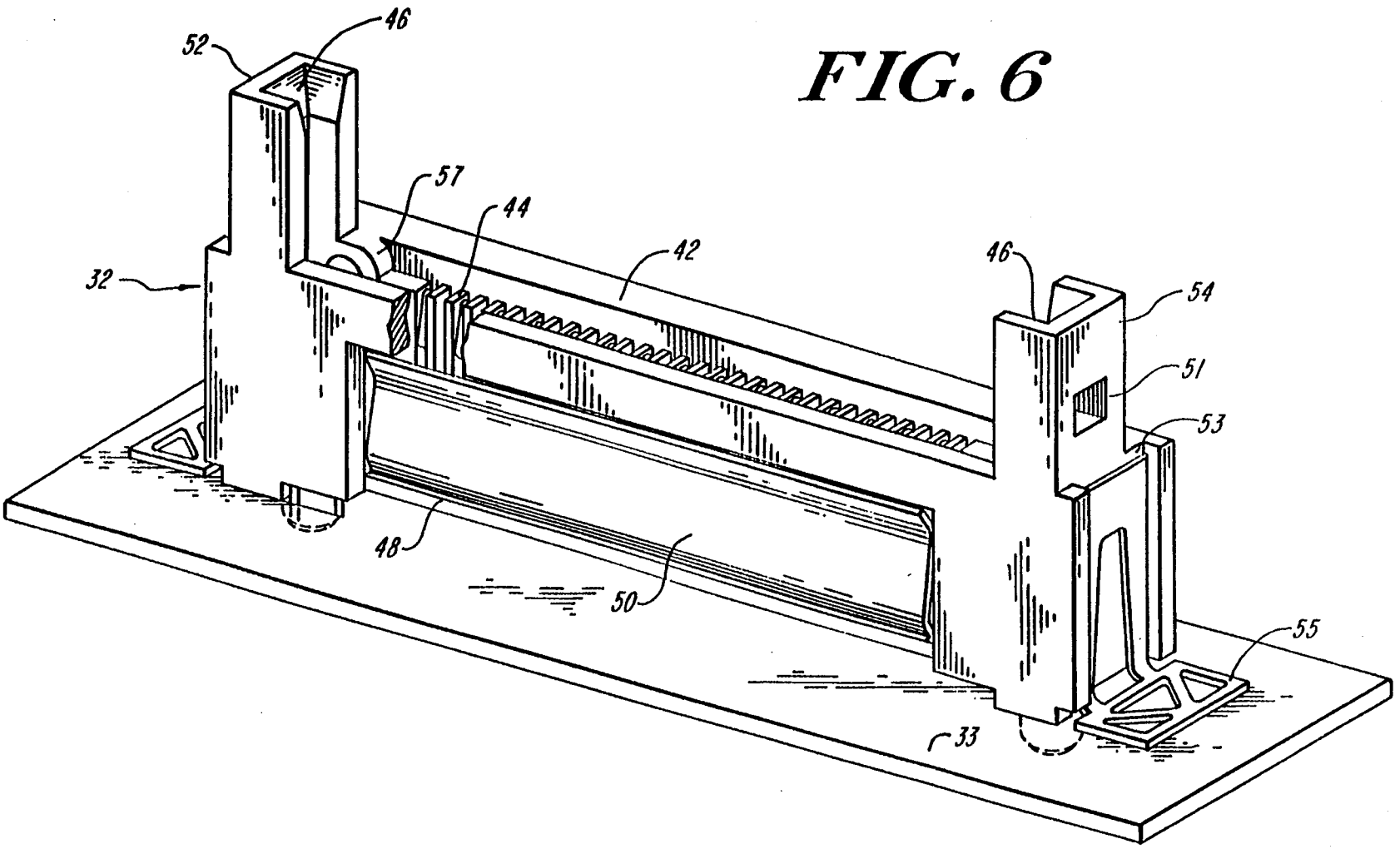
FIG. 6 is a perspective view of a connector portion of the edge card interconnection system of FIG. 5.

The connector portion 32, as illustrated in FIG. 6, includes an insulative contact housing 42 having a plurality of conductive contacts 44 disposed therein. The conductive contacts 44 can be disposed to accommodate multi-row staggered contact pads 34 (as illustrated in FIG. 5), or in-line contacts as known in the art. The insulative contact housing 42 has end portions 52, 54 defining a module slot 46 for receiving a module 36 and for facilitating alignment of the module 36 with the plurality of contacts 44. The insulative contact housing 42 is configured having a window 48 in which a backing spring 50 is disposed. The insulative contact housing 42 may be keyed 57 to ensure proper orientation of the module being inserted therein. End portions 52, 54 of the insulative contact housing 42 include engagement means 51 for receiving and facilitating retention of the module latching and protection mechanism 40 and engagement means 53 for receiving and facilitating retention of a connector hold-down mechanism 55, as discussed in greater detail hereinafter.

Figure 1:
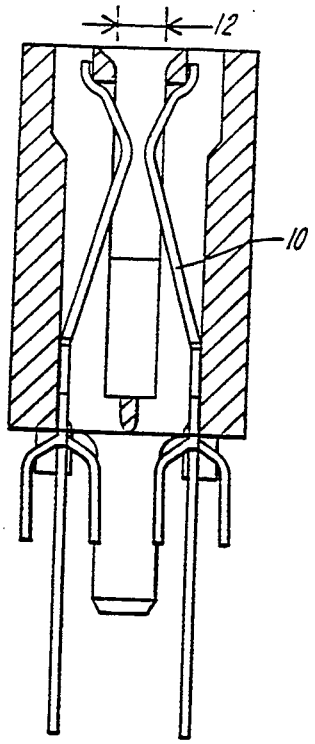
FIG. 1 (PRIOR ART)
FIG. 1 is a side section view of an edge card interconnection system according to the prior art.
Figure 2:
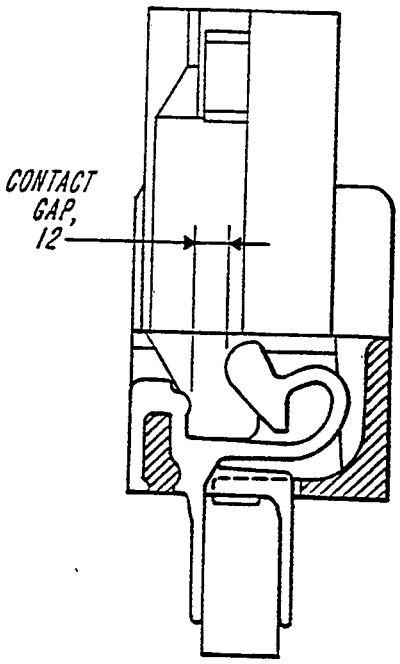
FIG. 2 (PRIOR ART)
FIG. 2 is a side section view of another edge card interconnection system according to the prior art.
Figure 3:
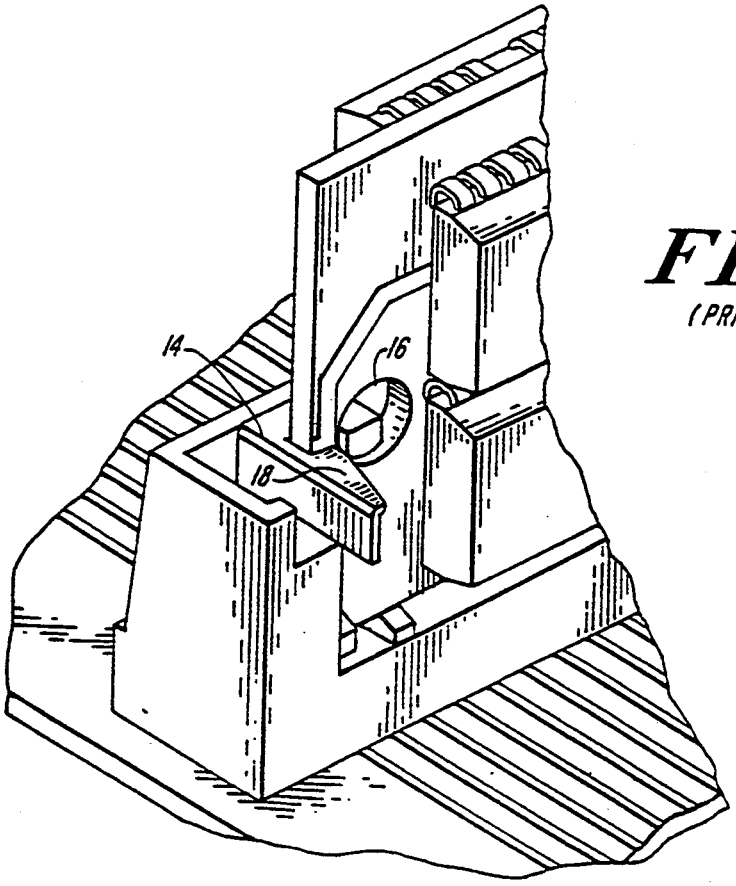
FIG. 3 (PRIOR ART)
FIG. 3 is a perspective view of a latching mechanism according to the prior art.
Figure 3A:
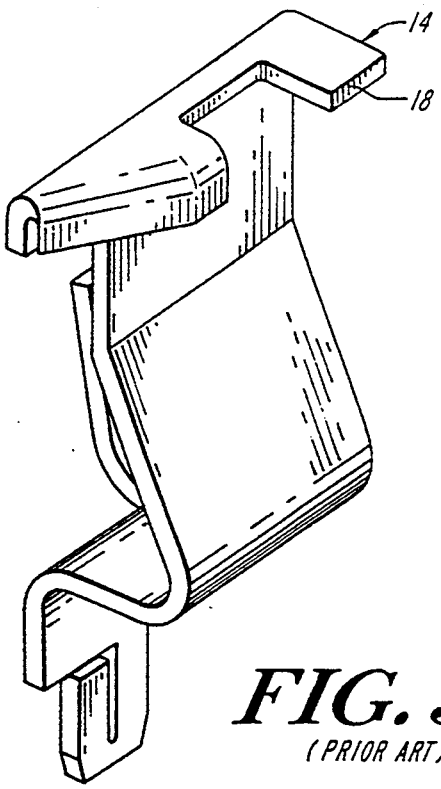
FIG. 3A (PRIOR ART)
FIG. 3A is a perspective view of a latch according to the prior art.
Figure 4A:
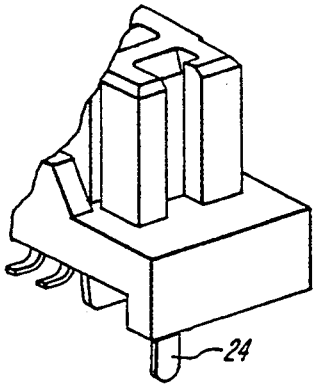
FIG. 4A (PRIOR ART)
FIG. 4A is a perspective view of another hold-down mechanism according to the prior art.
Figure 4:
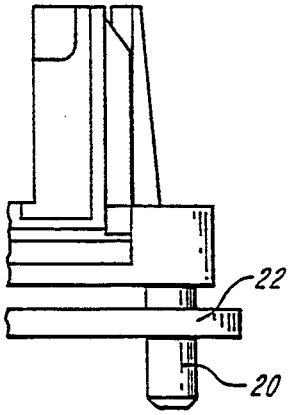
FIG. 4 (PRIOR ART)
FIG. 4 is a plan view of a hold-down mechanism according to the prior art.
Figure 7:
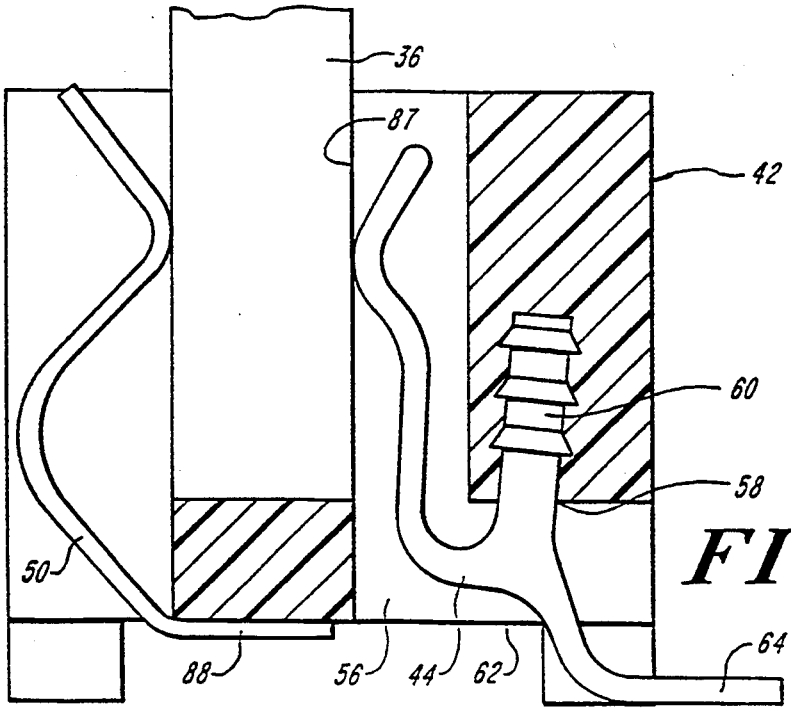
FIG. 7 is a side section view of the connector portion of FIG. 6.
Figure 8:
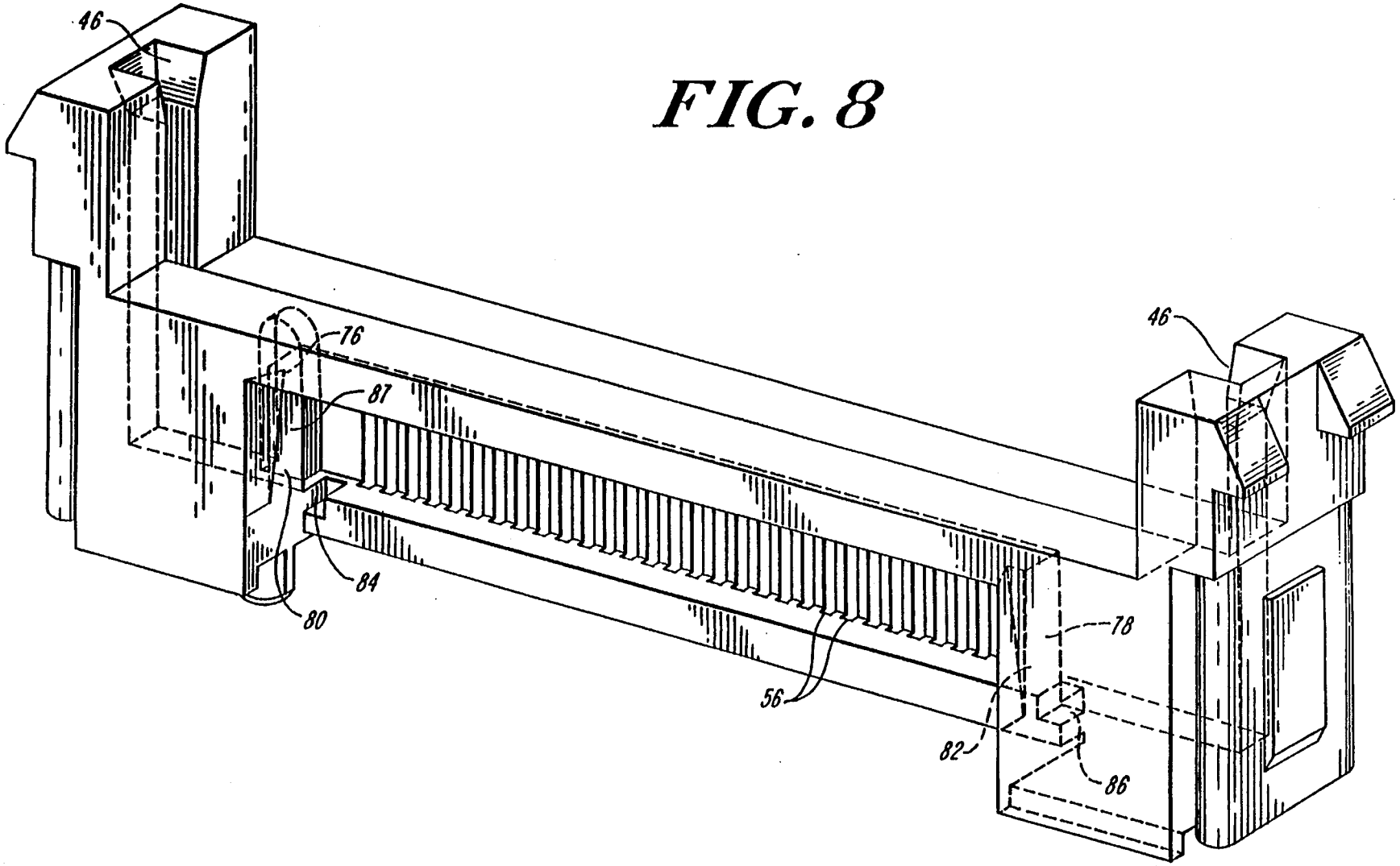
FIG. 8 is a perspective view partially in phantom of the connector portion of FIG. 6.
Figure 9:
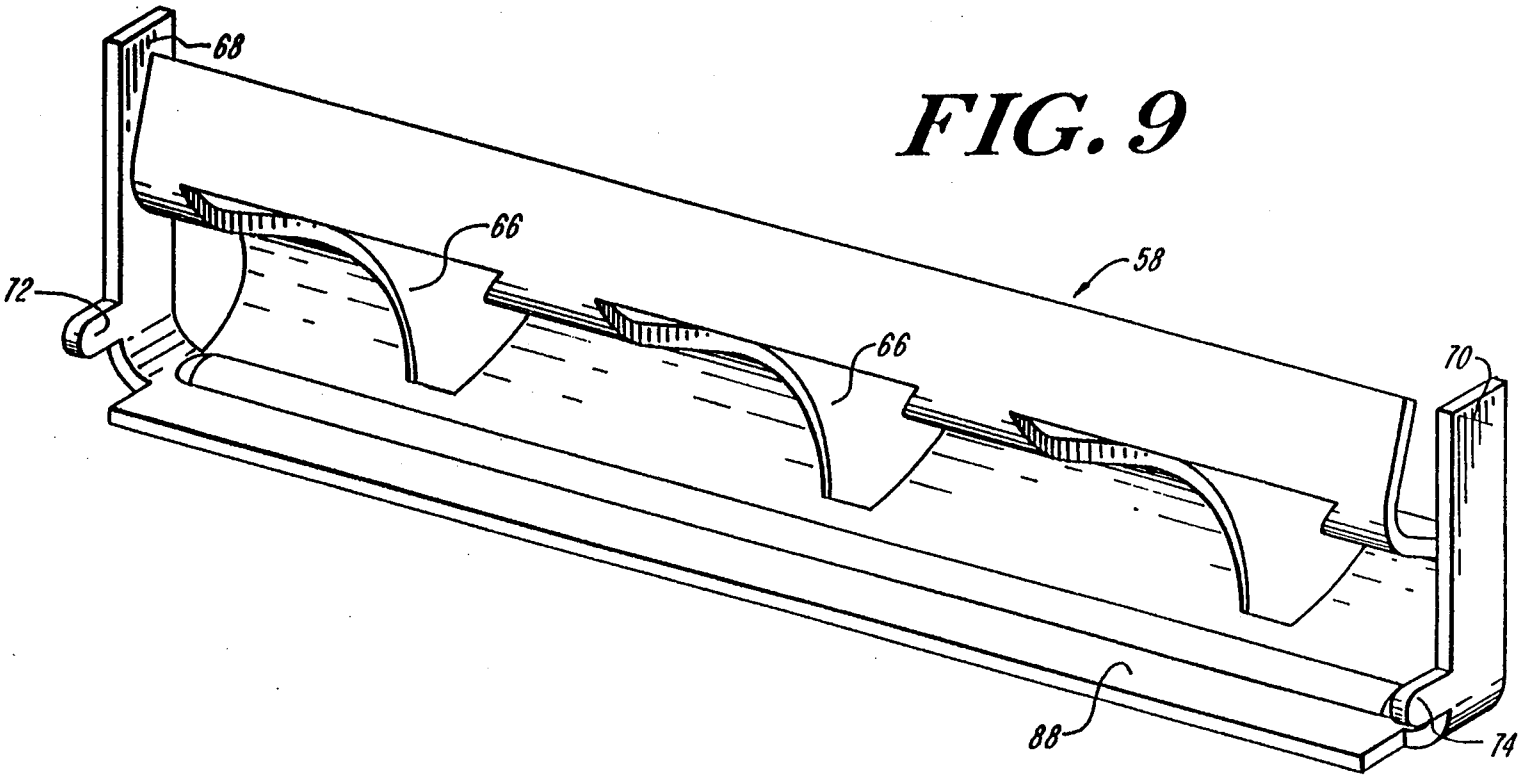
FIG. 9 is a perspective view of a backing spring for the connector portion of FIG. 6.

As illustrated in FIGS. 7, 8 and 9, the insulative contact housing 42 has contact slots 56, each for receiving a respective conductive contact 44. A contact barb cavity 58 is associated with each contact slot 56 and receives a contact barb portion 60 of the conductive contact 44 which is press-fit into its contact barb cavity 58 when the respective conductive contact 44 is press-fit into the contact slot 56 through a void 62 in a bottom side of the insulative contact housing 42. In the illustrative embodiment disclosed in FIGS. 7–9, a surface mount version is implemented and each contact has a respective surface mounting lead 64 associated therewith.

The insulative contact housing 42 defines the module slot 46 which receives the module 36, as discussed hereinbefore. Adjacent the module slot and disposed coaxially therewith, the window 48 accommodates the backing spring 50 which acts to push an installed module against the contacts 44. The backing spring 50 (best illustrated in FIG. 9) is fabricated from spring metal which is stamped to have a plurality of triangular cutouts 66 that enhance the springiness of the stamped spring steel. Stamping also effects a pair of spring arms 68, 70 at extreme ends of the backing spring 50. The spring arms 68, 70 are bent upwardly and provide resilient members for engaging the backing spring 50 within the insulative contact housing 42. Each spring arm 68, 70 has an associated arm tab 72, 74 which further facilitates engagement of the backing spring 50 within the insulative contact housing 42. Preferably, the backing spring 50 is coated or otherwise protected with an anti-corrosion agent.

The backing spring 50 is attached to the insulative contact housing 42 by the spring arms 68, 70. The spring 50 is inserted into the insulative contact housing 42 through window 48 by disposing the spring arms 68, 70 within ramps 76, 78 which lead to respective pockets 80, 82 in the insulative contact housing 42. When the spring is inserted into the bottom of the contact housing, the spring arms 68, 70 ride along the ramps 76, 78. After clearing the ramps 76, 78 the arms snap into place inside the pockets 80, 82. The spring arms resist movement in a direction away from the contact slots 56 because they are captive in the pockets 80, 82. Movement in the downward direction is prevented by the spring arm tabs 72, 74 which fit into respective tab slots 84, 86. Movement in the upward direction is prevented by a horizontal section 88 of the installed spring 50.

As best illustrated in FIG. 7, a module 36 is installed into the connector portion 32 including the insulative contact housing 42, the deflection of the conductive contacts 44 is controlled by a wall 87 against which the module 36 abuts to limit the travel thereof. Limiting travel of the module 36 abutting the insulative contact housing wall 87 prohibits the module 36 from deflecting the contacts 44 beyond a preset amount. Any tolerance(s) in the board thickness will be absorbed by the backing spring 50. Thus, the conductive contacts 44 do not need to be configured to accommodate a large amount of deflection and can therefore be made shorter to enhance electrical performance by minimizing the propagation delay that is experienced by an electrical signal as it is conducted through the connector.

Figure 10A:
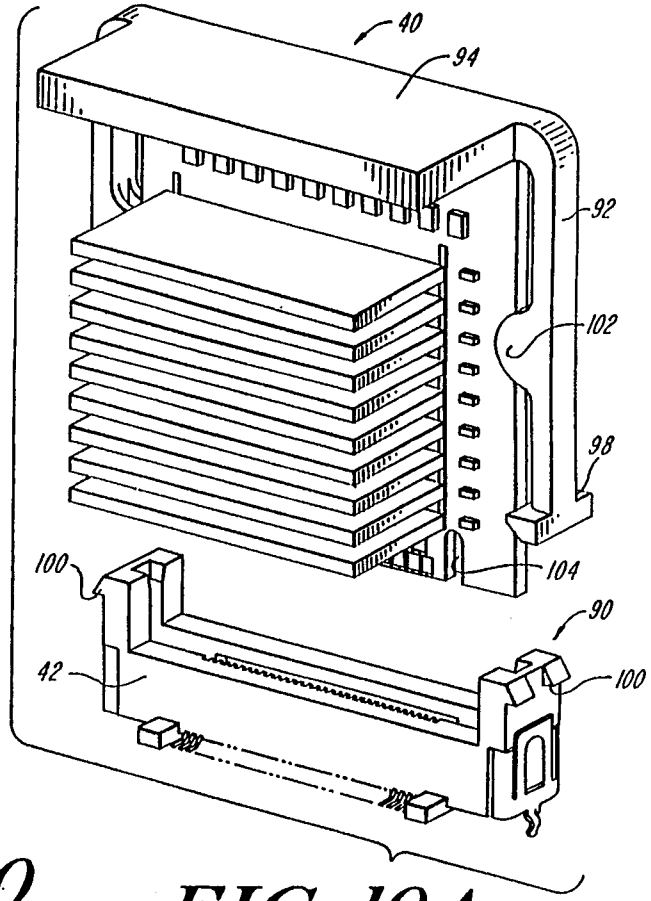
FIG. 10 is an alternative embodiment of a module latching and protection mechanism according to the invention.
FIG. 10B is a third alternative embodiment of a module latching and protection mechanism.
FIG. 10C is a fourth alternative embodiment of the module latching and protection mechanism.
Figure 10:
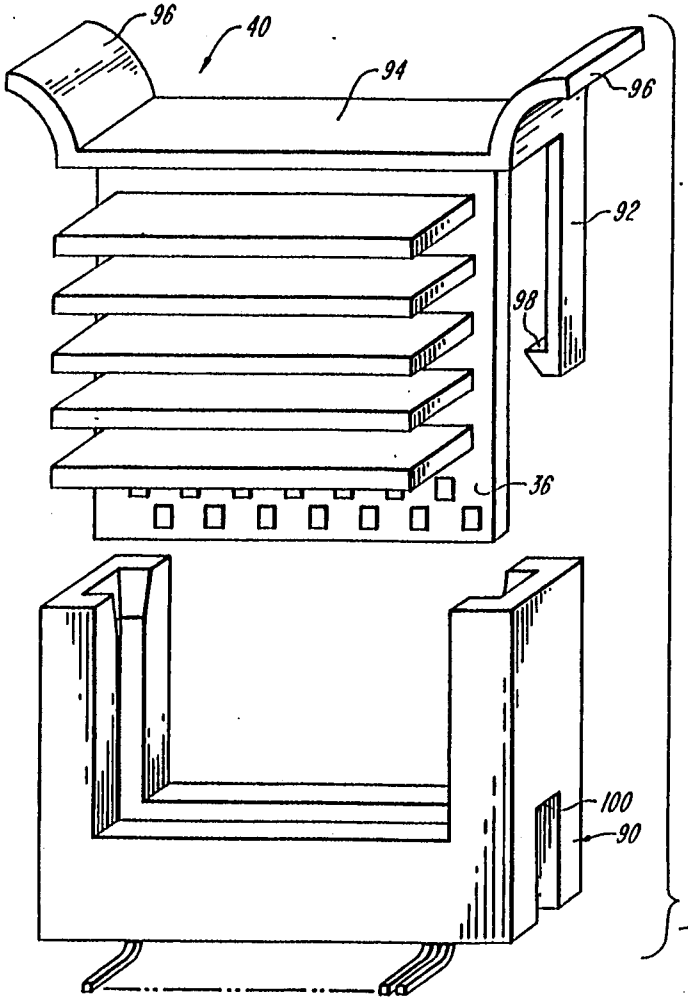
Figure 10B:
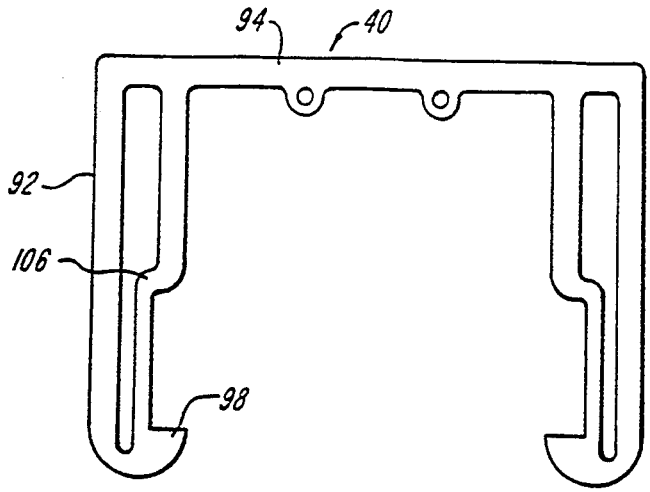
Figure 10C:
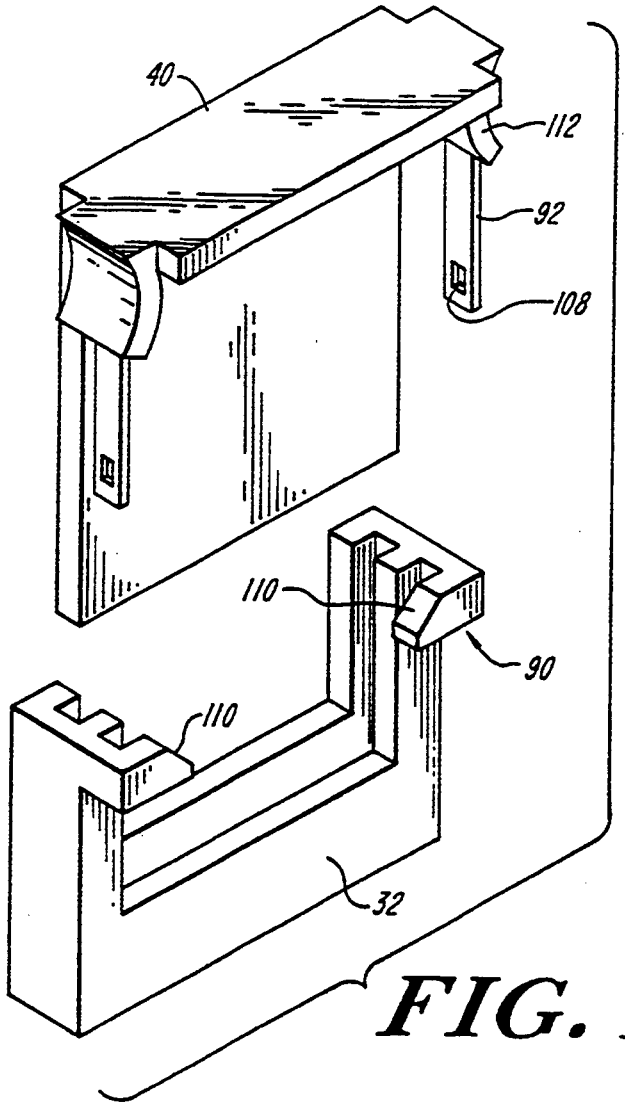

Referring now to FIGS. 10–10C, various module latching and protection mechanisms 40 can be implemented according to the invention. The latching mechanism requires a latch mating portion 90 disposed on the insulative contact housing 42 to interact therewith. The module latching and protection mechanism 40, in conjunction with the latch mating portion 90, serves to provide a means for insertion and retention of the module 36 within the contact housing 42. Extraction of the module 36 from the contact housing 42 is facilitated by the module latching and protection mechanism 40, which provides graspable members for manually holding the module 36 with limited physical engagement thereof. The latching and protection mechanism 40 may be provided with tactile and/or audible responsiveness, in the form of an audible click or perceptible release, to provide an indication of module/contact engagement and/or disengagement.

An illustrative latching mechanism, as illustrated in FIG. 10, comprises a pair of latch arms 92. The latch arms 92 are attached to a rigid horizontal member 94 which has a pair of arcuate projections 96, one each disposed at extreme ends of the rigid horizontal member 94.

The latch arms 92 are configured, in the illustrative implementation of FIG. 10, with latching surfaces 98 at an end thereof. The latching surfaces 98 engage the latch mating portion 90 when the module 36 is fully installed within the contact housing 42, and prevent removal of the module 36 as the latching surfaces 98 catch on corresponding latch mating portion surfaces 100.

The rigid horizontal member 94 extends outwardly over the module 36 and its associated components to provide protection of the associated components. The arcuate projections 96 disposed at the extreme ends of the rigid horizontal member 94 provide a protected area on which to exert forces with one's fingers. A grasping force exerted on the arcuate projections 96 causes the latching arms 92 to extend outward. Outward extension of the latching arms 92 releases the latching surfaces 98 of the latching arms 92 from engagement with the latch mating portion surfaces 100 whereupon the module 36 can be disengaged from the insulative contact housing 42.

As illustrated in an alternative embodiment of the module latching and protection mechanism 40 in FIG. 10A, latching arms 92 are alternatively configured having a fulcrum point implemented using a cam 102. The latching arms 92 similarly have an alternative implementation of a latching surface 98 which, when the module 36 is installed within the contact housing 42, engage an alternative embodiment of the latch mating portion surfaces 100. Inward pressure manually exerted at an upper portion of the latching arms 92, between the cam 102 and rigid horizontal portion 94 causes the latching arms 92 to extend outward. Outward extension of the latching arms 92 releases the latching surfaces 98 of the latching arms 92 from engagement with the latch mating portion surfaces 100 whereupon the module 36 can be disengaged from the insulative contact housing 42. A key 104 in the module 36, or associated with the latching mechanism 40 (not shown), facilitates proper orientation of a module for insertion into the insulative contact housing 42.

Referring now to FIG. 10B, still another alternative embodiment of a latching mechanism 40 is implemented using a fulcrum point. The fulcrum point is implemented in a hollow latching arm 92 by an alternative camming surface 106. Again, inward pressure manually exerted at an upper portion of the latching arms 92, between the cam 106 and rigid horizontal portion 94 causes the latching arms 92 to extend outward. Outward extension of the latching arms 92 releases the latching surfaces 98 of the latching arms 92 from engagement with the latch mating portion surfaces whereupon the module 36 can be disengaged from the insulative contact housing 42.

Similarly, FIG. 10C shows still another alternative embodiment of a latching mechanism 40. The latch arms 92 have female latching depressions or voids 108 which receive a male latch mating portion protuberance 110 which is integrated with the connector portion 32. When the module 36 is installed within the insulative contact housing 42 of the connector portion 32, the male latch mating portion 110 interfaces with the female latching depressions or voids 108, which are disposed interiorly with respect to the male protuberance 110 to retain the module latching protection mechanism 40 and module 36 within the connector portion 32. Inward pressure exerted on upper arcuate surfaces 112 of the latch arms 92 causes the latch arms and associated female latching depressions or voids 108 to actuate outwardly releasing the male protuberance 110 and freeing the module latching and protection mechanism 40 to be removed from the connector portion 32.

Figure 11:
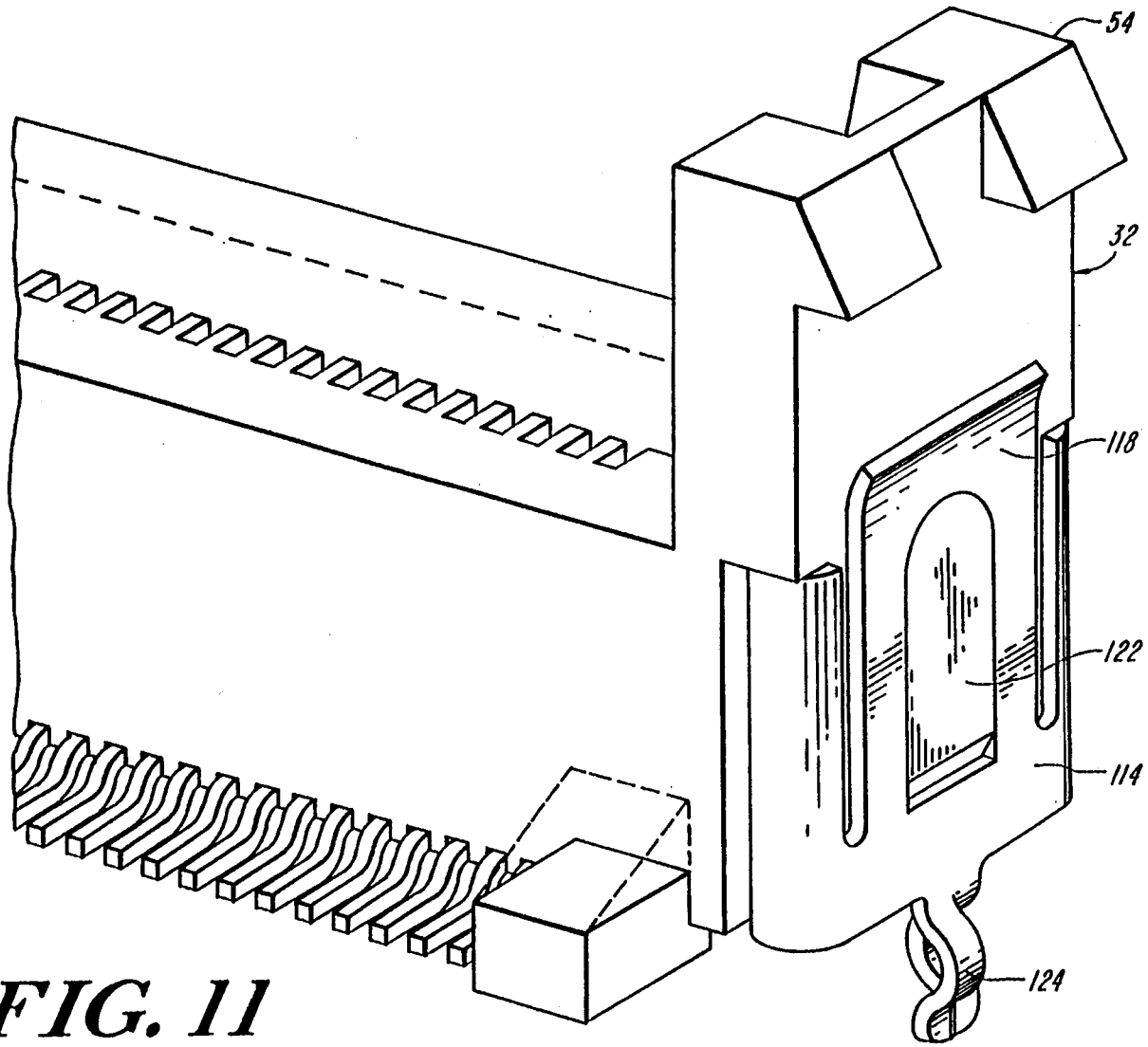
FIG. 11 is a perspective view of a connector hold-down mechanism on the edge card interconnection system of FIG. 1.
Figure 11A:
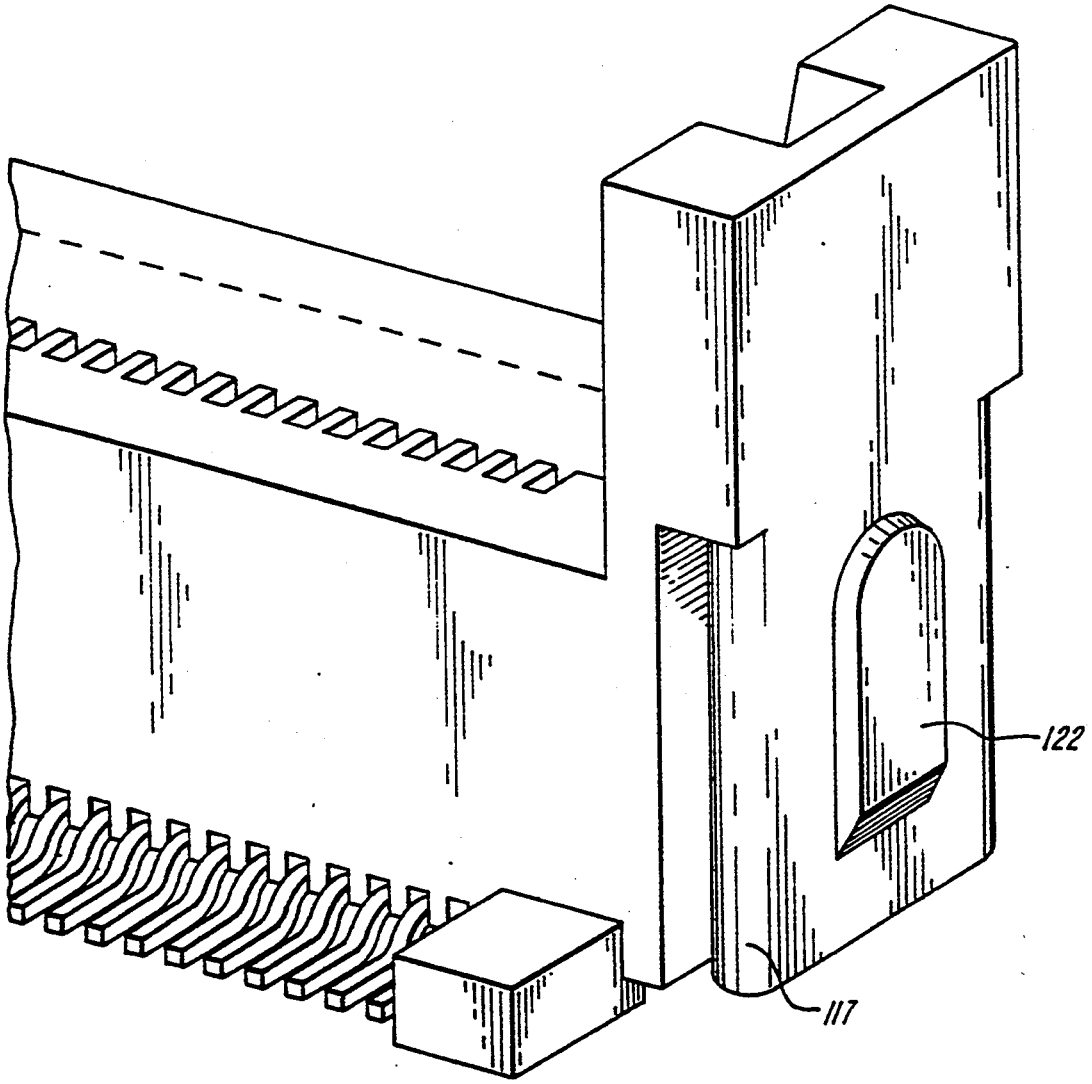
FIG. 11A is an end portion of a connector housing having a hold-down engagement area for receiving the connector hold-down mechanism as illustrated in FIG. 11.

Referring now to FIGS. 11–11B the connector portion 32 of the edge card interconnection system, according to the invention, comprises a hold-down member 114 which is used to fasten the connector portion 32 to a circuit board (not shown in FIG. 11). The hold-down member 114 preferably is removably installed onto end portions 52, 54 of the insulative contact housing 42. In the illustrative embodiment, grooves 116 (FIG. 11A) in the hold-down member 114 mate with rails 117 (FIG. 11B) in the insulative housing 42 to guide the hold-down member 114 into place on the insulative housing 42. A resilient tab 118 having an open interior section 120 rides up an inclined extension 122 as the hold-down member 114 is actuated onto the insulative housing 42. The tab 118 becomes captively engaged with the inclined extension 122 upon the hold-down member 114 being fully actuated onto the insulative housing 42. The hold-down member 114 comprises a compliant portion 124 which engages a plated through-hole and barrel (not shown) within a circuit board onto which the connector portion 32 is mounted. The compliant portion 124 can be compressed or can remain in a fully expanded state to accommodate varying dimensioned through-holes while ensuring proper contact with the barrel thereof. Such assured contact provides firm adherence in conjunction with a wave or solder reflow process to achieve an enhanced fastening effect.

While the invention is described herein having a single stamped backing spring it will be appreciated that alternative spring elements can be implemented, such as by using a plurality of individual springs to effect absorption of module thickness tolerances. Further, materials other than stamped spring steel can be used to implement a backing spring, such as composites, flexible polymeric material or other resilient materials.

Figure 12A:
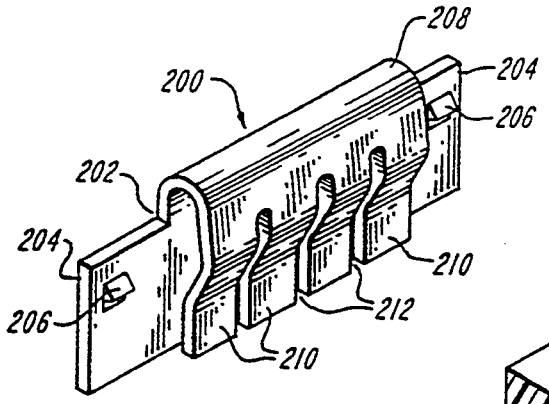
FIGS. 12A, 12B, 12D and, 12C and 12E are perspective views and side sectioned views respectively of an alternative embodiment of a backing spring for the connector portion of the interconnection system according to the invention.

Referring now to FIGS. 12A, an alternative backing spring implementation is illustrated. The backing spring 200 is fabricated from stamped and formed resilient material such as spring steel and includes a single beam 202 having retaining ends 204 with tangs or retaining lances 206 disposed thereon for retaining the backing spring within a housing as illustrated and discussed hereinafter. The backing spring 200 has a bight portion 208 connecting a plurality of backing spring members 210 with the beam 202. The backing spring members 210 are bent so as to be preloaded to provide sufficient biasing to a module installed in the connector housing. A plurality of cut-outs 212 are disposed in the backing spring members 210 to accommodate irregularities in a module confronting the spring members and to absorb thickness tolerances therein.

Figure 12B:
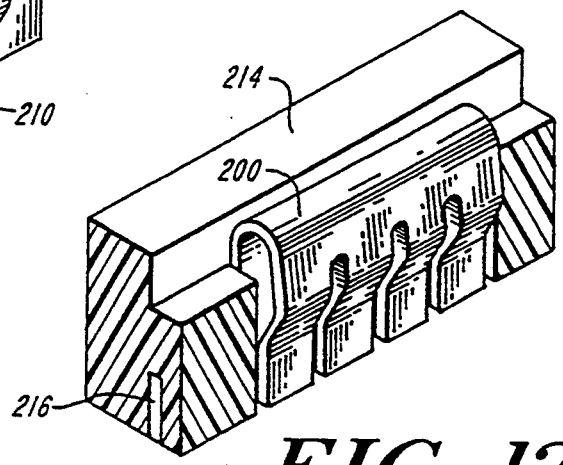
Figure 12C:
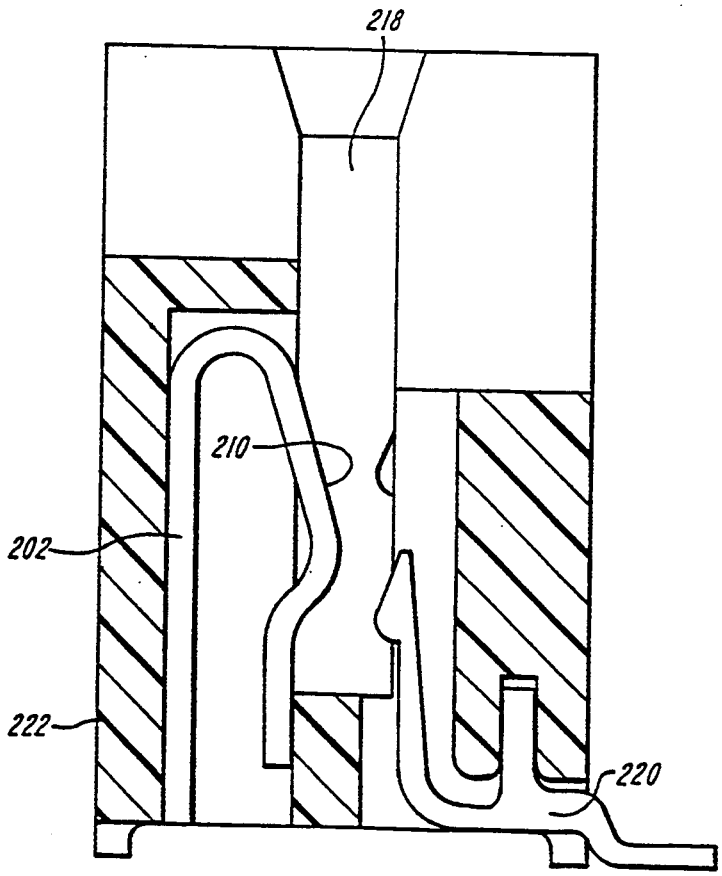

The backing spring 200 is disposed within an insulative housing 214, as illustrated in FIGS. 12B and 12C. The retaining members 204 are disposed within a retaining slot 216 of the housing. Upon bottom loading of the backing spring 200 into the housing 214, the tangs 206 frictionally engage the insulative material of the housing to retain the backing spring 200 within the housing. The backing spring members 210 extend into a recess 218 within the housing 214 to engage a portion of the module disposed therein and to bias the module, having contact pads thereon, toward contacts 220 disposed within the housing, as discussed hereinbefore. The beam portion 202 abuts and is supported by a backing wall 222 of the housing (best seen in FIG. 12C) and distributes forces exerted on the spring members 210 and beam portion 202 thereover.

Figure 12D:
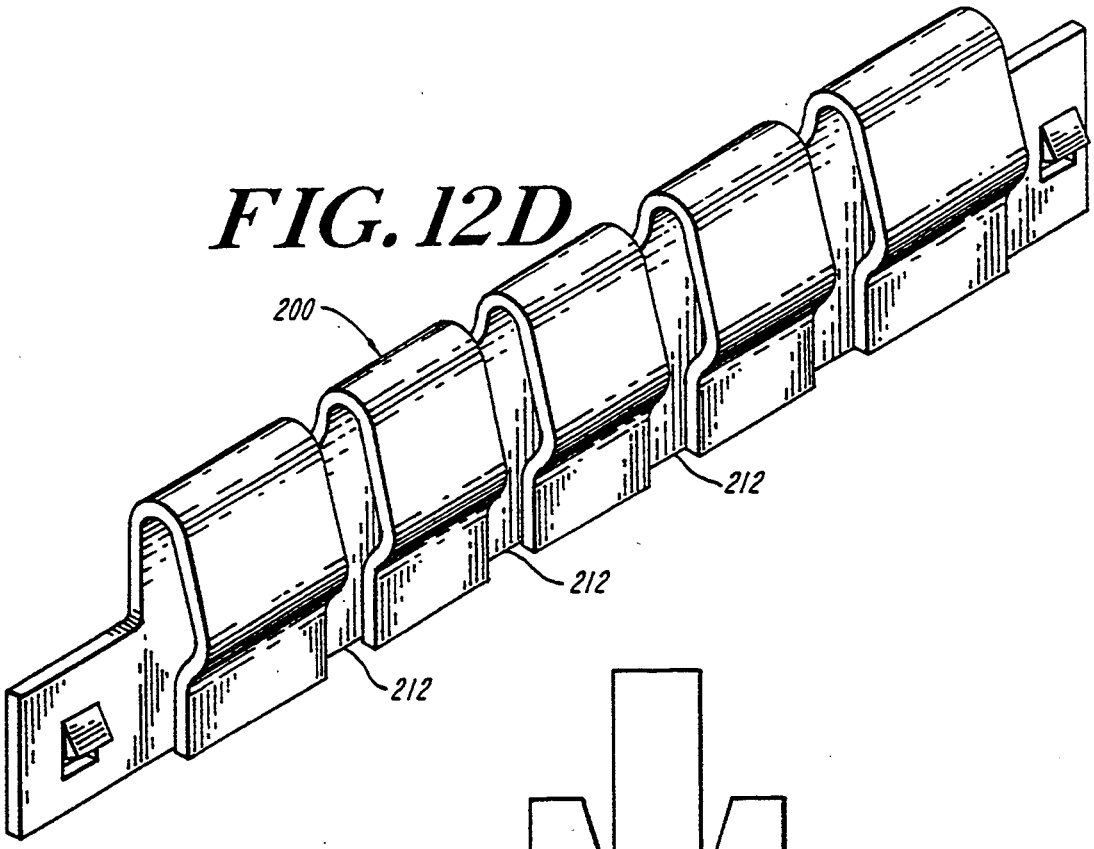
Figure 12E:
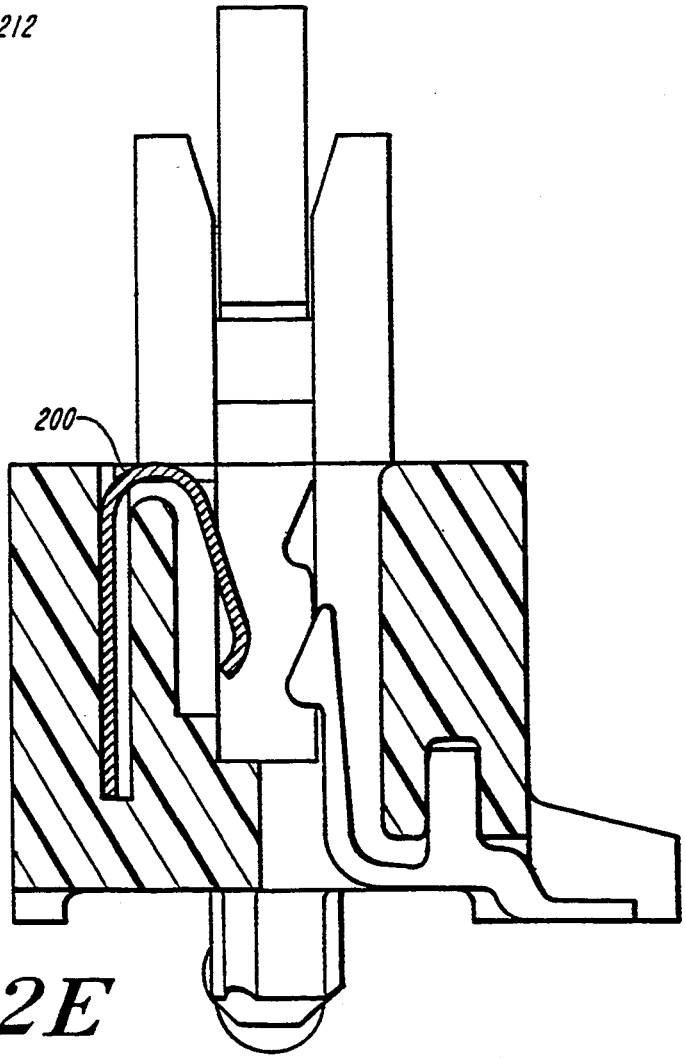

The backing spring 200 can be configured having virtually any number of spring members 210, as illustrated in FIG. 12D, with virtually any number of cut-outs 212 disposed between the spring members 210. Similarly, the dimensions of the spring members as determined by the spacing between cut-outs, can be varied. Furthermore, as illustrated in FIG. 12E, the configuration or shape of the spring member can be varied, the spring can be configured with or without preload and the spring and/or associated housing can be configured so that the spring can be installed into the top of the housing.

Figure 13A:
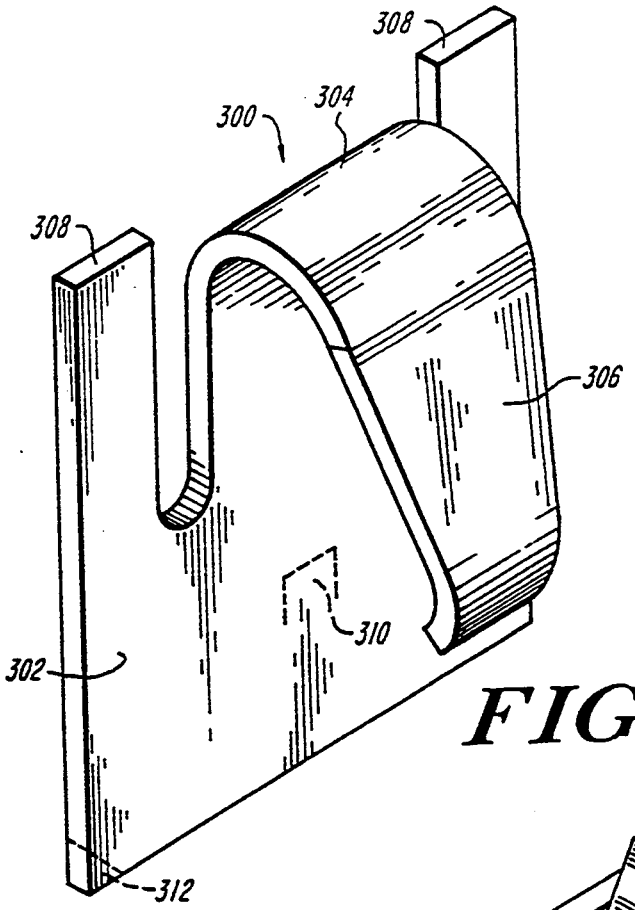
FIGS. 13A and 13B are perspective views of another alternative embodiment of a backing spring.
Figure 13B:
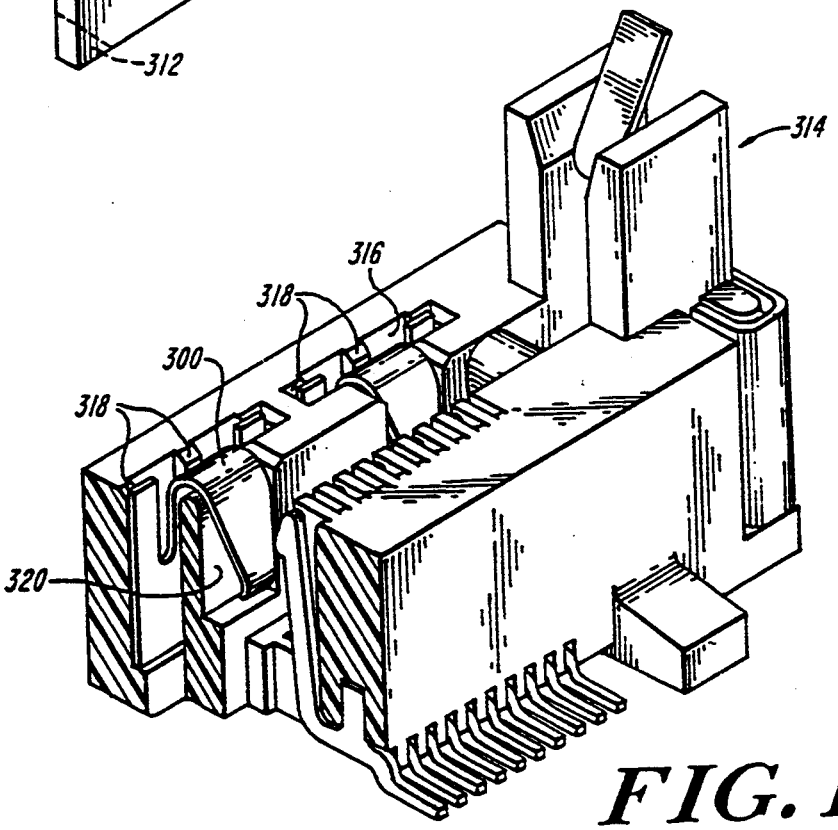

Another alternative embodiment of the backing spring is illustrated in FIGS. 13A and 13B. The illustrative singular backup spring 300 comprises a backing plate 302 with a bight portion 304 and a tapered spring portion 306 extending therefrom. The tapered spring portion 306 is tapered to optimize deflection characteristics of the spring 300. A pair of backing beams 308 are disposed on either side of the tapered spring portion 306. The singular backup spring 300 is fabricated by stamping and forming metal such as spring steel and can be implemented including a tang 310 and/or chamfered corners 312 to facilitate engagement with the housing as discussed hereinafter.

An insulative housing for receiving the singular backup spring 300 is illustrated in FIG. 13B. A plurality of cavities 316 are each configured for receiving a respective one of a plurality of singular backup springs 300. The cavities 316 each include a plurality of bearing surfaces 318 which support the backing beams and backing plate of the singular backup springs 300. The housing 314 further includes taper recesses 320 which accommodate the tapered spring portion 306 of a respective singular backing spring and effect a stop limiting travel of the tapered spring portion 306.

Figure 14A:
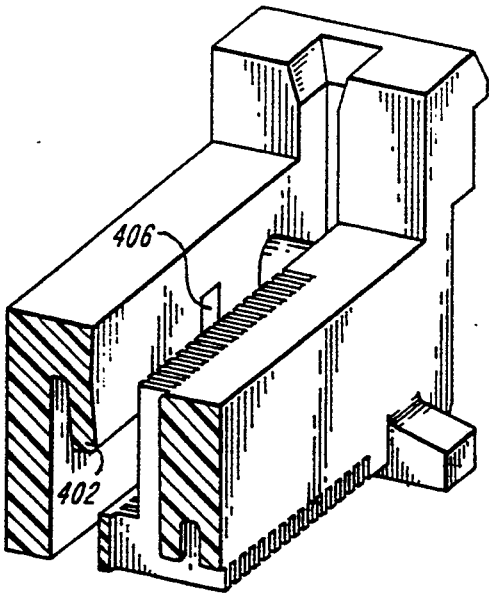
FIGS. 14A, 14B and 14C are perspective views of a housing having an integral backing spring.
Figure 14B:
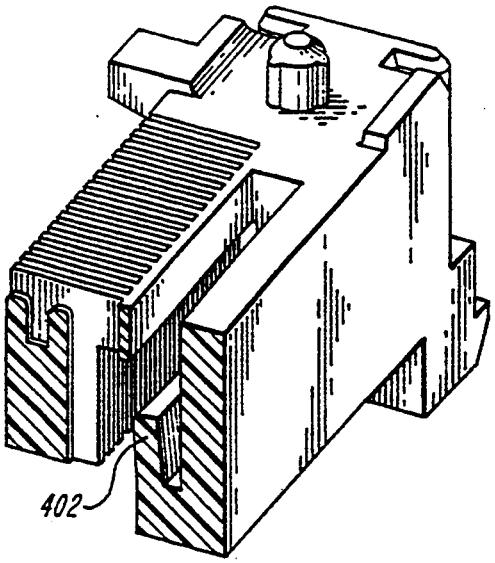
Figure 14C:
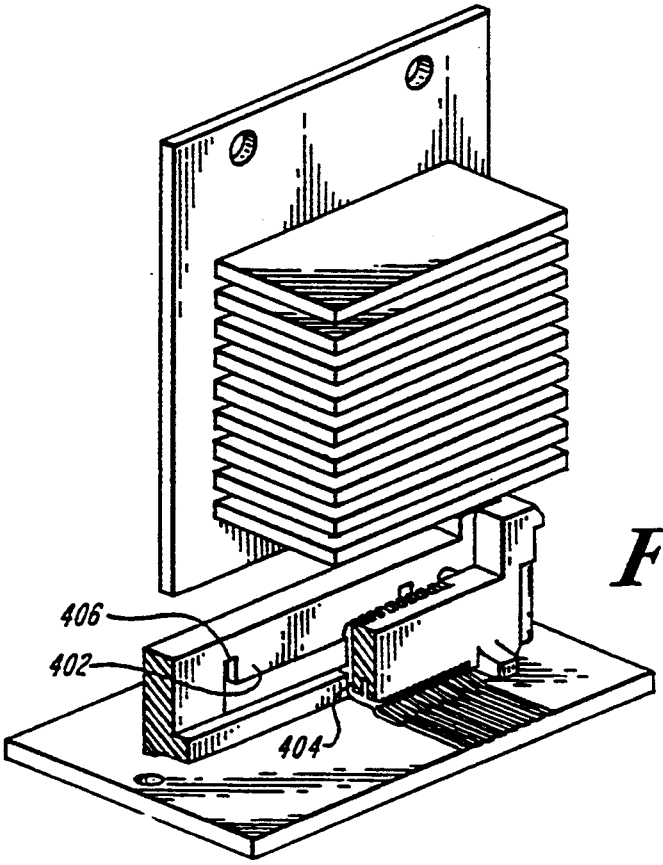

A backing spring can be implemented as an integral portion of the insulative housing, such as illustrated in FIGS. 14A, 14B and 14C. Such an integral backing spring is formed of the molded insulative material from which the insulative housing of the connector portion is fabricated. The spring is formed as a cantilevered beam 402 extending from an interior wall of the insulative housing with a slight incline toward contacts 404 (best seen in FIG. 14C) disposed opposite the integral backing spring 402. The backing spring 402 can have a plurality of cut-outs 406 disposed therein to accommodate board thickness tolerances.

Figure 15A:
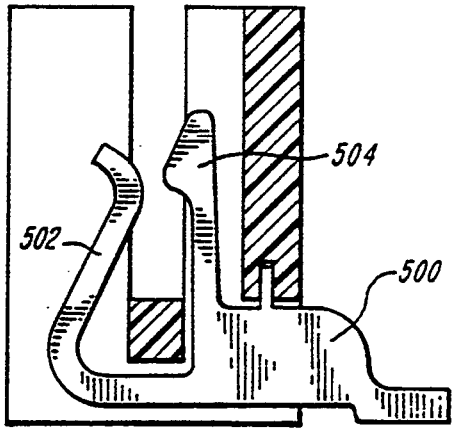
FIGS. 15A, 15B and 15C are side section and perspective sectioned views respectively of contacts having an integral backing spring.
Figure 15B:
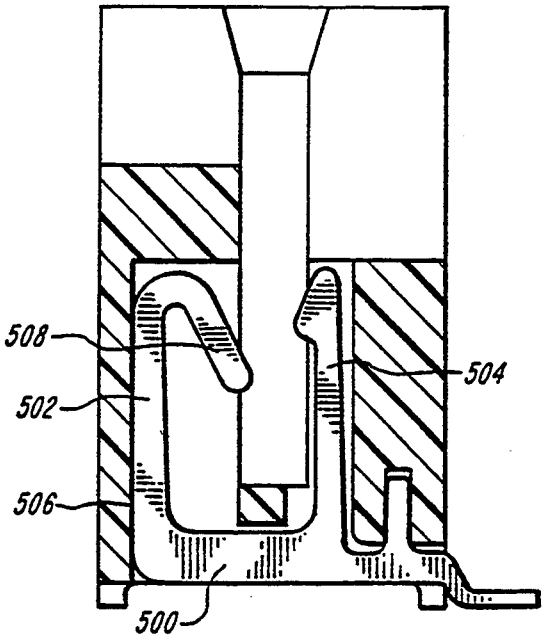
Figure 15C:
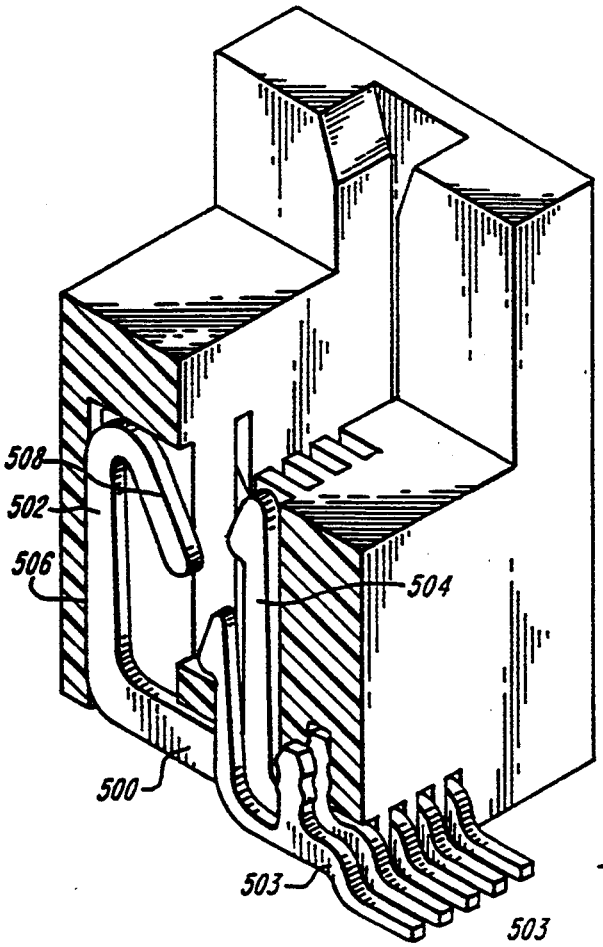

Still another implementation of a backing spring for urging a printed circuit board toward the contacts in an interconnection system according to the invention is illustrated in FIGS. 15A, 15B and 15C. Such implementation is a backing spring integral with contact pins 500. A biasing portion 502 of power and/or ground contacts functions to bias a module installed within the connector portion toward signal contacts 503 disposed opposite the biasing portion(s). The biasing portion 502 is fabricated to be significantly stiffer than an electrical contact portion 504 of the same contact pin 500. The electrical contact portion 504 engages power and/or ground contacts on an installed module (not shown). A back side portion 506 of the biasing portion 504, in the implementations of FIG. 15B and 15C, confronts a portion of the insulative housing wall and transfers forces thereto, such that only a top portion 508 of the contact pin 500 flexes. As illustrated in FIG. 15C, the integral biasing spring/contact 500 can be installed in the insulative housing alternately with signal contacts 503 or in various configurations wherein integral biasing spring-/contacts 500 are interspersed among signal contacts.

Numerous alternative implementations of a module latching and protection mechanism can be implemented, in addition to those disclosed herein to protect and latch a module within an associated connector portion. Additionally, although latching mechanisms having latching and mating surfaces are described herein it will be appreciated by one of ordinary skill in the art that engagement of the protection mechanism with the connector portion can be effected by means other than latching surfaces, such as by frictional engagement or friction fitting.

While the hold-down mechanism is described herein in the context of an interconnection system having a connector portion and a latching and protection mechanism, it will be appreciated that such a hold-down mechanism can be used in any application wherein it is desirable to enhance interconnection to a printed circuit board or other module.

Although the invention has been shown and described with respect to exemplary embodiments thereof, various other changes, omissions and additions in form and detail thereof may be made therein without departing from the spirit and scope of the invention.

What is claimed is:

1. An interconnection system connecting a second module to a first module wherein said second module has at least one contact pad disposed proximate to an edge thereof, and at least some electrical circuitry disposed thereon, comprising:

a connector portion attached to said first module, said connector portion including an insulative housing having at least one latch mating portion and at least one receiving cavity in a sidewall of skid housing, at least one electrical contact for interconnection with said at least one contact pad, and at least one biasing member positioned in said receiving cavity for engaging said second module comprising a backing spring said backing spring comprising a backing plate, a plurality of backing beams extending from an end of said backing plate, and a spring portion extending from said backing plate via a bight portion positioned between said backing beams, and wherein said at least one biasing member is disposed within said connector portion opposite said at least one electrical contact;

a channel disposed within said connector portion and defined by said at least one electrical contact, said at least one biasing member and said insulative housing, said channel receiving a portion of said second module which is biased toward said at least one electrical contact by said at least one biasing member; and a separable protection portion, fastened to said second module at least partially limiting physical access to said at least some electrical circuitry disposed thereon, said protection portion having at least a latch engagable with said at least one mating portion of said insulative housing of said connector portion to retain said second module in electrical connection with said first module.

2. The interconnection system of claim 1 wherein said at least one biasing member is a stamped metallic spring.

3. The interconnection system of claim 1 wherein said at least one biasing member further comprises a tang frictionally engaging a portion of said insulative housing to retain said at least one biasing member therein.

4. The interconnection system of claim 1 wherein said at least one biasing member further comprises at least one chamfered corner.

5. The interconnection system of claim 1 wherein said spring portion of said at least one biasing member is tapered to optimize deflection characteristics.

* * * * *